United States Patent [19]

Watters

[11] Patent Number: 4,493,957

[45] Date of Patent: Jan. 15, 1985

[54] MULTIMODAL PRESSURE SWITCH

[75] Inventor: Wayde H. Watters, Kent, Wash.

[73] Assignee: Red Dot Corporation, Seattle, Wash.

[21] Appl. No.: 474,702

[22] Filed: Mar. 11, 1983

[51] Int. Cl.[3] ..... H01H 35/24; H01H 3/32

[52] U.S. Cl. ..... 200/81 R; 200/81.4; 200/83 R; 200/83 S; 200/153 T

[58] Field of Search ..... 200/81 R, 81.4, 81.6, 200/83 R, 83 C, 83 J, 83 P, 83 S, 83 SA, 83 Z, 153 T, 6 BB, 67 R

[56] References Cited

U.S. PATENT DOCUMENTS

| | | | |
|---|---|---|---|
| 3,210,486 | 10/1965 | Holzer | 200/81 R X |
| 3,898,405 | 8/1975 | Weber | 200/83 S X |
| 3,946,174 | 3/1976 | Herbst | 200/83 C X |
| 4,048,455 | 9/1977 | Forsythe et al. | 200/81.4 |

*Primary Examiner*—J. R. Scott

*Attorney, Agent, or Firm*—Joan H. Pauly

[57] ABSTRACT

The conical tip of a load applying member (42) acts against one side (136) of a movable plate (120). A spring (84) urges the conical tip of a biasing member (88) against the other side (138). In response to a relatively small movement of member (42) against plate (120), plate (120) pivots about a first axis $a_1$ to depress the operator (102) of a first snap-action switch (98). In response to a relatively large movement of member (42), plate (120) pivots away from contact with operator (102), first about auxiliary axis $a_4$ and then about third axis $a_3$. In response to an intermediate movement, plate (120) pivots to depress the operator (103) of a second snap-action switch (99), first about second axis $a_2$ and then about auxiliary axis $a_4$. Axis $a_4$ is defined by first and second fulcrums (71, 134). Axis $a_2$ is defined by second fulcrum (134) and operator (102); axis $a_3$ is defined by first fulcrum (71) and operator (103). Axis $a_1$ is defined by the line along which edge (A) of plate (120) contacts insert (22) from which the tip of member (42) projects. A single variable pressure signal causes each such movement of member (42).

20 Claims, 10 Drawing Figures

38
18
132
10
36
A
136
P
120
SB
138
134
12
60
92
62
122
88
122
102
103
97
71
96
118
98
66
65
119
101
100
99
67
63
112
111
64
94
95
110
113
115
116
117
128
114
14
126

Fig. 2
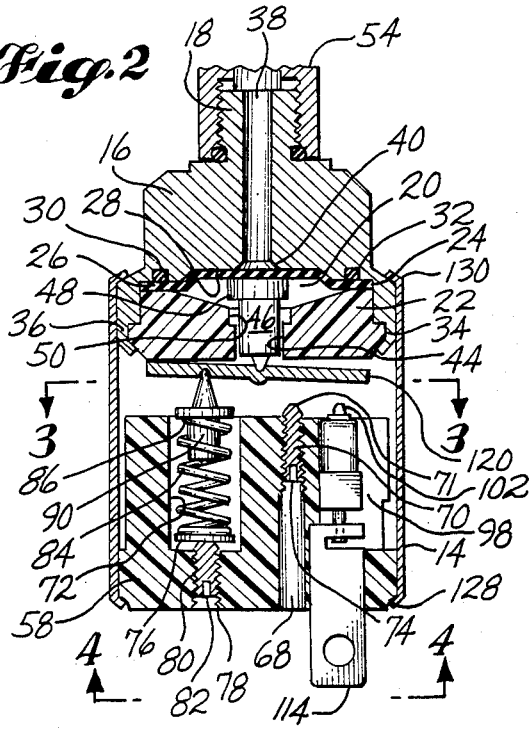
Fig. 3
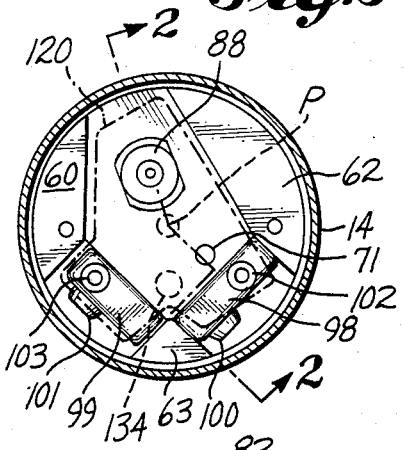
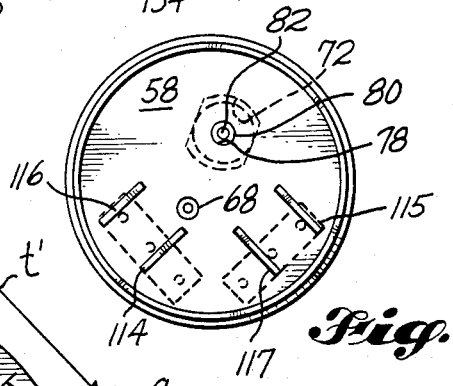
Fig. 4
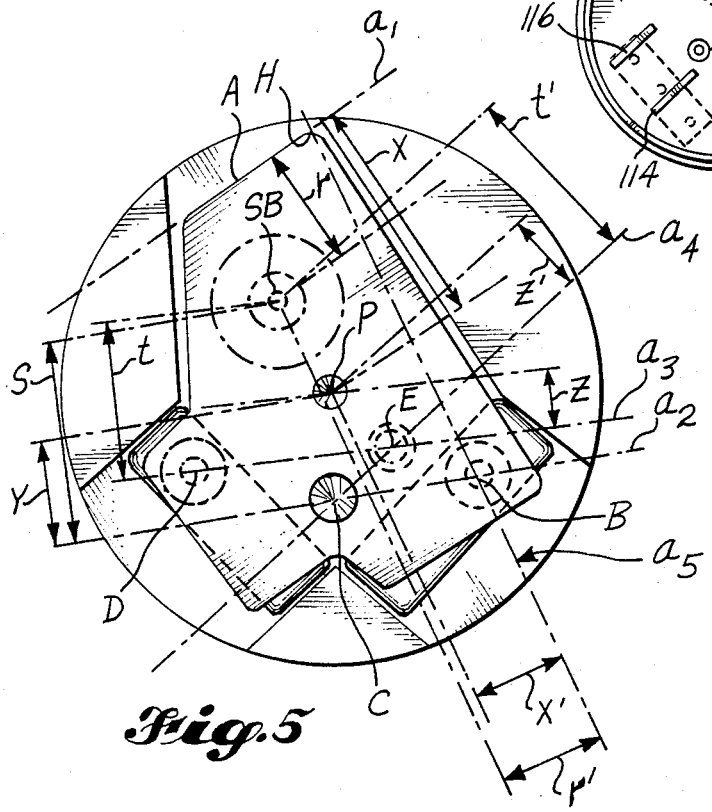
Fig. 5

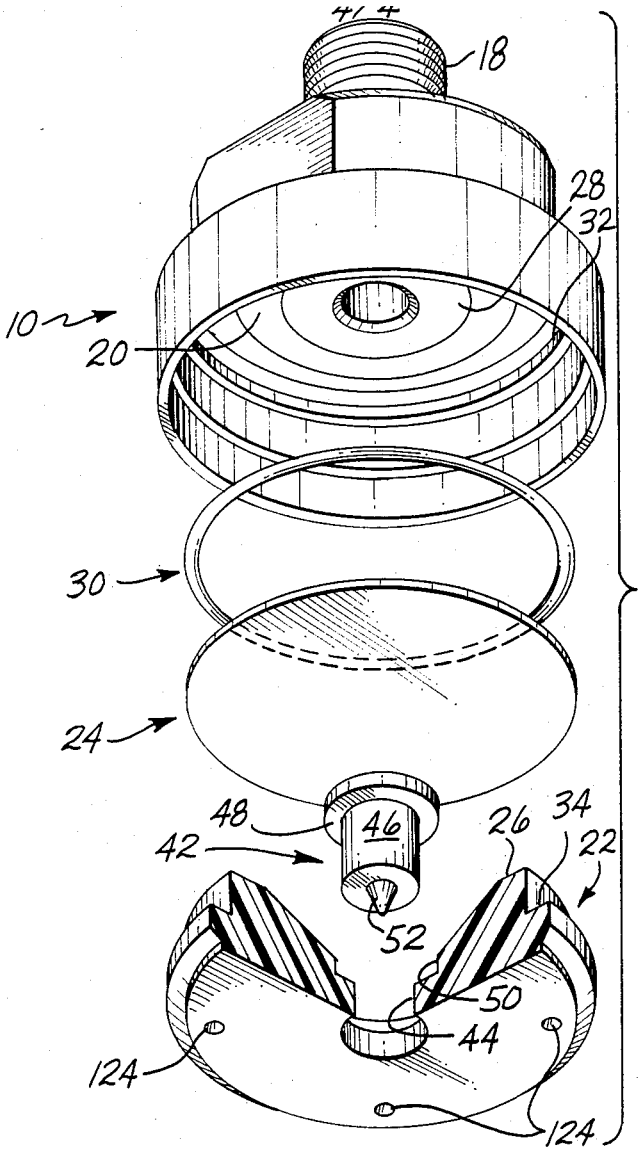
Fig. 9
Fig. 10
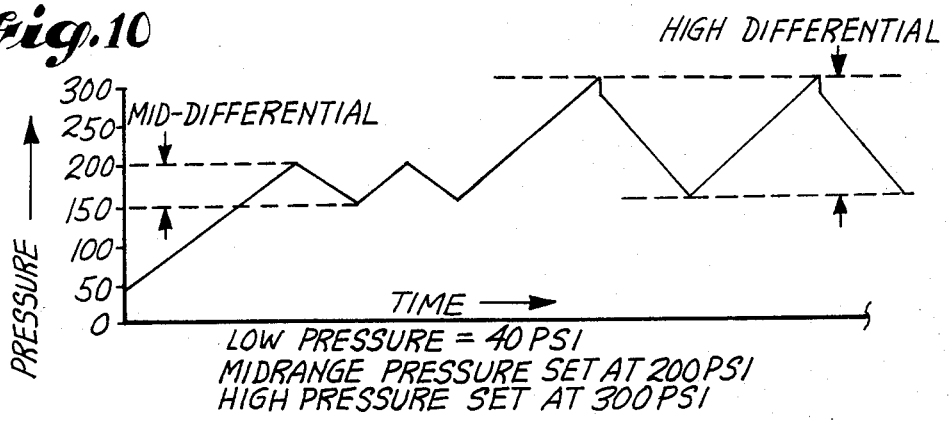

MULTIMODAL PRESSURE SWITCH

DESCRIPTION

TECHNICAL FIELD

This invention relates to electric switch mechanisms and, more particularly, to a multifunction switch mechanism that is responsive to a single variable signal, such as a pressure signal, that includes a snap-action switch, and that has an increased differential range to reduce cycling frequency.

BACKGROUND ART

Pressure signal operated switches are well-known. It is also well-known to use a number of such pressure switches in combination, arranged to open or close electrical circuits in response to different pressure levels from a single source of pressure. The use of multiple switches is not suitable in some installations because it requires the availability of multiple suitable mounting locations for the switches, one for each switch, multiple taps into the pressure system, and multiple conduits leading from the tap points to the switches. In installations in which there are fewer suitable mounting locations for pressure switches and/or fewer suitable tap points than there are functions to be controlled by a pressure signal, multiple switches either cannot be used or require undesirable compromises in order to make their use possible. For example, in many vehicle air-conditioning systems it is desirable to have a multimodal response to the compressor head pressures but there is generally only one suitable mounting location for a pressure switch. This has led to the undesirable compromise of locating one pressure switch in the suitable protected location and locating the other pressure switch or switches in locations in which the switches are insufficiently protected from the environment. The unprotected switches are subject to destructive environmental influences that can lead to early failure and to an overall lessening of reliability.

An object of the present invention is to provide a single switch mechanism that requires only a single mounting location and a single tap-in point and that is adapted to perform plural switching functions in response to variations in a single pressure signal. It is further an object of the present invention to provide such a switch mechanism that is suitable for use in vehicle air-conditioning systems, including those in which there is only one suitable protected mounting location for a pressure switch.

In certain applications that require a multifunction switch mechanism responsive to a single variable pressure signal, the normal operation of the system requiring the switch mechanism involves the regular cycling of the pressure signal between pressure levels. For example, in some vehicle air-conditioning systems an auxiliary cooling mechanism for the condenser is provided to be operational when the pressure in the compressor reaches a certain level and to cease operation when the pressure drops below a certain level. It is desirable to reduce the regular cycling frequency of such a mechanism in order to avoid wear of and the noise caused by the auxiliary cooling mechanism, to save energy and to avoid wear of the switch mechanism itself. Therefore, it is another object of the present invention to provide a multimodal pressure switch that has an increased differential range to reduce the frequency of the regular cycling.

If the pressure can not be reduced by the auxiliary cooling mechanism and the pressure continues to rise, it is necessary to turn the compressor off to prevent damage. It is imperative that the pressure drop back down to the normal range before the compressor is started again or clutch failure may result. Therefore, it is desirable to provide a time delay or differential range between deactivation and reactivation of the compressor that is sufficiently large to ensure that the pressure is in the normal range before the compressor is reactivated. Such a differential range will reduce wear of the compressor and the clutch. Hence, it is still another object of the present invention to provide a multimodal pressure switch that has such a differential range.

The patent literature includes numerous known switches and switch systems. Of particular interest is U.S. Pat. No. 4,048,455, granted Sept. 13, 1977, to Alan K. Forsythe and Charles J. Green. This patent discloses a multifunction pressure switch with a pivotal conduction plate.

The above patent and the prior art that is discussed and/or cited therein should be studied for the purpose of putting the present invention into proper perspective relative to the prior art.

DISCLOSURE OF THE INVENTION

The subject of this invention is a switch mechanism. According to a basic aspect of the invention, the switch mechanism includes a snap-action switch when in use forms a part of an electrical circuit. This snap-action switch has a reciprocating operator. A movable member has a first side that faces toward the reciprocating operator and a second side essentially opposite said first side. Support means is provided for supporting the movable member by making supporting contact with at least two support points on said second side of the movable member. A biasing member makes point contact with said first side of the movable member at a location that is offset from both the reciprocating operator and said support points. Means is provided for mounting the biasing member for reciprocating movement along a line that includes its point of contact with the movable member and that extends generally transversely of the movable member. Also provided is spring means for biasing the biasing member toward the movable member and the movable member into contact with the support means and into a spaced relationship with the reciprocating operator. A load applying member makes point contact with said second side of the movable member at a location spaced toward the reciprocating operator from both the biasing member and said support points. Means is provided for supporting the load applying member for movement along a line that includes its point of contact with the movable member and that extends generally transversely of the movable member. Fulcrum means is positioned to contact said first side of the movable member at a location spaced toward the reciprocating operator from the load applying member. The relative spacing of the reciprocating operator, said support points, the point of contact between the biasing member and the movable member, the point of contact between the load applying member and the movable member, and the fulcrum means is such that certain movements of the load applying member will pivot the movable member. A first movement of the load applying member toward the movable member will pivot the movable member in position about a first axis that includes said support points, to depress the biasing member, compress the spring means, and move the movable member into contact with the reciprocating operator to depress said operator and operate the snap-action switch. A subsequent additional movement of the load applying member in the same direction will cause the movable member to pivot in position about the fulcrum means, to further depress the biasing member, further compress the spring means, and move the movable member out of contact with the reciprocating operator.

According to another aspect of the invention, the switch mechanism further comprises a second snap-action switch. This second switch in use forms a part of a second electrical circuit. The second switch includes a reciprocating operator positioned to be contacted and depressed by the movable member to operate said second switch in response to an intermediate movement of the load applying member in the same direction as said first and subsequent movements.

According to another aspect of the invention, the switch mechanism further comprises a second fulcrum means positioned to contact said first side of the movable member at a location that, together with the location of contact between the movable member and the reciprocating operator of the first snap-action switch, defines a second axis. Both the reciprocating operator of the second snap-action switch and the point of contact between the load applying member and the movable member are laterally offset from the second axis. The operator of the second switch is closer to the second axis than is the point of contact between the load applying member and the movable member. The movable member pivots about the second axis in response to an intermediate movement of the load applying member. Preferably, the points of contact between the movable member and the first fulcrum means and the second fulcrum means together define an auxiliary axis from which the reciprocating operators of the first and second switches and the point of contact between the load applying member and the movable member are laterally offset; and in response to an intermediate movement of the load applying member, the movable member first pivots about the second axis to make contact with the first fulcrum means and then pivots about the auxiliary axis to make contact with and depress the reciprocating operator of the second switch to operate the second switch.

In embodiments of the invention that include a second snap-action switch with a reciprocating operator that is depressed by the movable member in response to an intermediate movement of the load applying member, an axis is preferably defined by the location of contact between the movable member and the reciprocating operator of the second switch and the location of contact between the movable member and the fulcrum means. Both the reciprocating operator of the first switch and the point of contact between the movable member and the load applying member are laterally offset from this axis. The movable member pivots about this axis in response to said subsequent additional movement of the load applying member. Preferably, the switch mechanism further comprises second fulcrum means positioned to contact the first side of the movable member at a location that, together with the location of contact between the first fulcrum means and the movable member, defines an auxiliary axis. The reciprocating operators of the first and second switches and the point of contact between the load applying member and the movable member are laterally offset from this auxiliary axis. In response to said subsequent additional movement of the load applying member, the movable member first pivots about the auxiliary axis against the reciprocating operator of the second switch and then pivots about the axis defined by the locations of contact between the movable member and the reciprocating operator of the second switch and the first fulcrum means to move out of contact with both the reciprocating operator of the first switch and the second fulcrum means.

According to still another aspect of the invention, the point of contact between the movable member and the load applying member is closer to the third axis than it is to the other three axes, closer to the auxiliary axis than it is to the first and second axes, and closer to the second axis than it is to the first axis.

The switch mechanism of the invention may also include additional features. For example, the mechanism may be provided with means for receiving a pressure signal and applying it against the load applying member to cause said movements of the load applying member. Another example is the provision of the movable member in the form of a substantially flat plate, with the point of contact between the plate and the load applying member at a laterally central location on the second side of the movable member.

According to a preferred aspect of the invention, the position of the fulcrum means is adjustable toward and away from the movable member. The adjustment of the position of the fulcrum means permits the adjustment of the magnitude of subsequent additional movement of the movable member required to move the movable member out of contact with the reciprocating operator. Similarly, in embodiments including first and second fulcrum means, the position of the first fulcrum means is preferably adjustable toward and away from the movable member. This permits the adjustment of the magnitude of intermediate movement of the movable member required to depress the reciprocating operator of the second switch.

According to another preferred aspect of the invention, said first movement of the load applying member first pivots the movable member about the first axis to operate the snap-action switch and then pivots the movable member about an axis defined by one of said support points and the location of contact between the movable member and the reciprocating operator of said switch. In embodiments that include this feature, a second snap-action switch, and second fulcrum means, said first movement preferably first pivots the movable member to operate the first snap-action switch and then pivots the movable member to move said member into contact with the second fulcrum means.

According to another basic aspect of the invention, the switch mechanism has a first portion with inner and outer ends. This first portion carries a snap-action switch. The switch has a reciprocating operator positioned at the inner end of the first portion and includes a pair of conductive legs that project outwardly as terminals from the outer end of the first portion. A movable member has a first side facing toward said inner end and the reciprocating operator and a second side essentially opposite the first side. A biasing member makes point contact with the first side of the movable member at a location that is offset from the reciprocating operator. The biasing member is supported by the first portion for reciprocating movement along a line that includes its point of contact with the movable member and that extends generally transversely of the movable member. The switch mechanism also has a second portion with inner and outer ends. This second portion includes at its inner end support means for supporting the movable member by making supporting contact with at least two support points on the second side of the movable member. The support points are offset from both the reciprocating operator and the point of contact between the movable member and the biasing member. Spring means bias the biasing member towards the movable member and the movable member into contact with the support means and into a spaced relationship with the reciprocating operator. A load applying member makes point contact with the second side of the movable member at a location spaced toward the reciprocating operator from both the biasing member and the support points. The load applying member is supported by the second portion for reciprocating movement along a line that includes its point of contact with the movable member and that extends generally transversely of the movable member. Fulcrum means is positioned on the inner end of the first portion to contact the first side of the movable member at a location spaced toward the reciprocating operator from the load applying member. The relative spacing of the reciprocating operator, the support points, the point of contact between the biasing member and the movable member, the point of contact between the load applying member and the movable member, and the fulcrum means is such that certain movements of the load applying member will pivot the movable member. A first movement of the load applying member toward the movable member will pivot the movable member in position about a first axis that includes the support points, to depress the biasing member, compress the spring means, and move the movable member into contact with the reciprocating operator to depress the operator and operate the snap-action switch. A subsequent additional movement of the load applying member in the same direction will cause the movable member to pivot in position about the fulcrum means, to further depress the biasing member, further compress the spring means, and move the movable member out of contact with the reciprocating operator.

Preferably, the second portion of the switch mechanism includes means for receiving a pressure signal and applying it against the load applying member to cause said movements of the load applying member. Also preferably, the switch mechanism includes a second snap-action switch carried by the first portion and operated by an intermediate movement of the load applying member. This second switch includes a pair of conductive legs that project outwardly as terminals from the outer end of the first portion and that are laterally spaced from the conductive legs of the first switch.

It should be obvious that switches constructed according to the present invention have the advantages of satisfying each of the objects of the present invention set forth above. These advantages and the features of the present invention described above, as well as other features and advantages, will become apparent from the detailed description of the best mode for carrying out the invention that follows.

BRIEF DESCRIPTION OF THE DRAWINGS

In the drawings, like element designations refer to like parts throughout, and:

FIG. 2 is a vertical sectional view of the switch mechanism shown in FIG. 1 taken substantially along the line 2—2 in FIG. 3.

FIG. 3 is a cross-sectional view taken along the line 3—3 in FIG. 2.

FIG. 4 is a bottom plan view taken along the line 4—4 in FIG. 2.

FIG. 5 is a top plan view similar to FIG. 3, showing in detail the movable plate of the preferred embodiment and showing the axes of rotation of the plate and the moment arms associated with the load applying member and the biasing member.

FIG. 9 is an exploded pictorial view looking up at the preferred embodiment of the second portion of the switch mechanism.

FIG. 10 is a graph illustrating pressure versus time in a system in which the preferred embodiment of the switch mechanism has been incorporated.

BEST MODE FOR CARRYING OUT THE INVENTION

Figure 1:
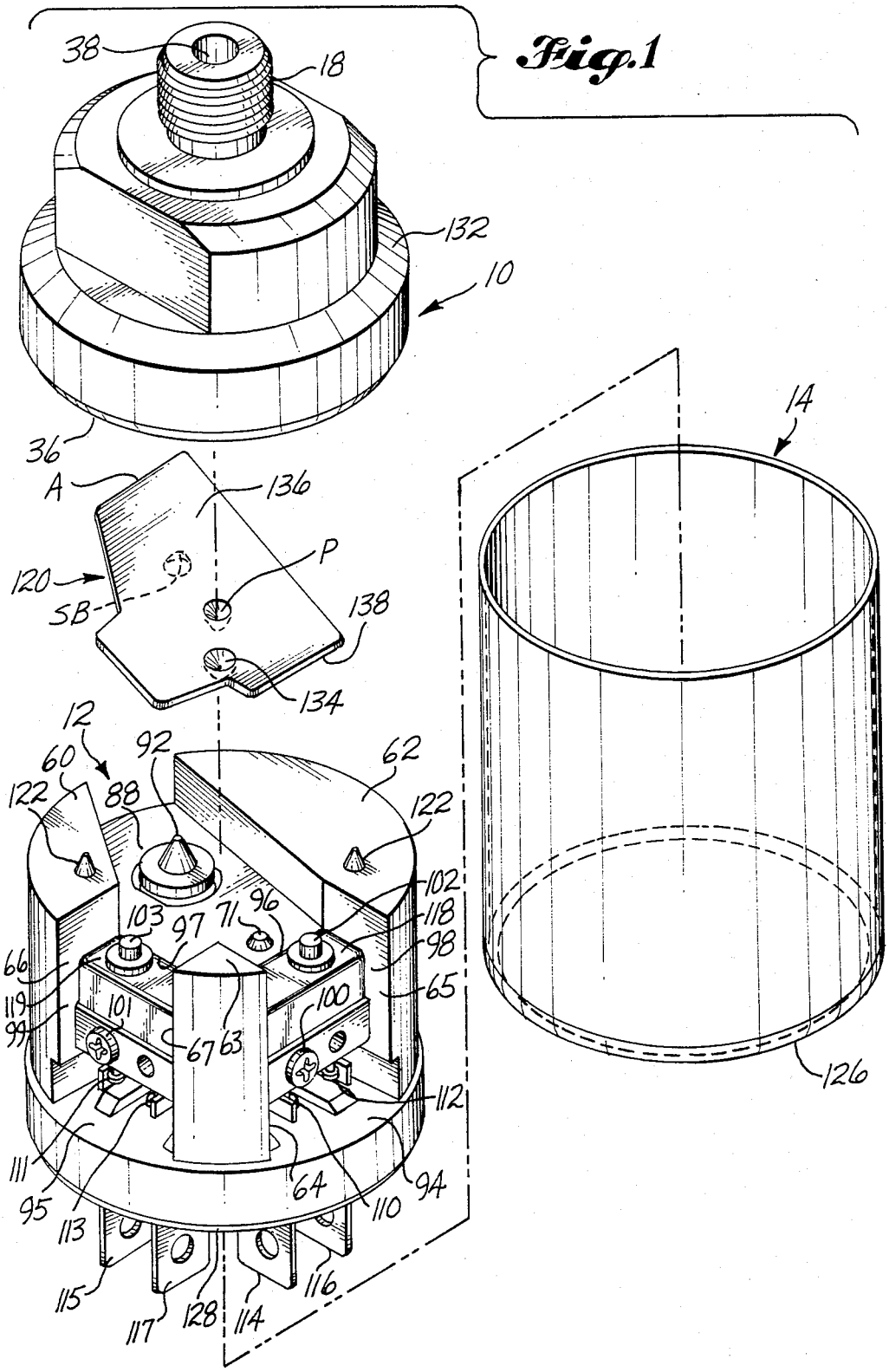
FIG. 1 is an exploded pictorial view looking down on the preferred embodiment of the switch mechanism of the invention.

The drawings show a switch mechanism that is constructed according to the invention and that also constitutes the best mode of the invention currently known to the applicant. Referring to the drawings, the switch mechanism is shown to comprise three major components. These are a second or sensor portion 10, a first or electrical parts portion 12, and an outer casing 14.

As shown by FIGS. 1, 2, and 9, the sensor portion 10 comprises a main body 16 having an exteriorly threaded stem 18 at its outer end and a shallow cavity 20 at its inner end. A generally disk-shaped insert 22 is received within the cavity 20. A flexible wall or diaphragm 24 is located between the insert 22 and the base of the cavity 20. Preferably, the insert 22 is formed to include at its periphery an annular relatively thick portion 26 which engages the peripheral portion of the diaphragm 24 when all parts of the sensor portion 10 are assembled. Insert 22 also preferably includes a peripheral flange 34, adapted to be received within, and retained by, an annular channel formed in part by an annular lip 36 provided at the inner end of body 16. The lip 36 is initially cylindrical in shape. After the diaphragm 24 and the insert 22 are installed into the cavity 20, the lip 36 is rolled inwardly into tight engagement with the flange 34.

The base of the cavity 20 has a radially outer portion and a radially inner recessed portion 28. When the switch mechanism is in a rest position (no pressure signal), as shown in FIG. 2, the diaphragm rests against the base of cavity 20 and has a flattened hat shape, with the top of the hat extending into the recessed portion 28. The radially outer portion of the base has an annular groove 32 into which an O-ring 30 is received. The O-ring 30 makes sealing contact with the walls of the groove 32 and the surface of the radially outer "brim" of the diaphragm 24 opposite the thick portion 26 of the insert 22. The peripheral "brim" of the diaphragm 24 is in turn engaged by the thick portion 26 of the insert 22, as described above. This arrangement provides a seal between the spaces on either side of the diaphragm 24 and also secures the diaphragm 24 in place.

Body 16 is formed to include an axial passageway 38 having an enlarged inner end 40 where it meets the diaphragm 24. A load applying member 42, constructed from a suitable hard material, makes contact with the central portion of diaphragm 24. Insert 22 includes a two-part central passageway for member 42. The first part 44 is relatively small in diameter and is sized to receive and pass a relatively small diameter portion 46 of member 42 and is too small to pass a larger diameter base portion 48 of member 42. The second and larger diameter portion 50 of the central passageway in insert 22 is sized to receive base portion 48 of member 42. Insert 22 also includes a frustoconical surface portion that tapers inwardly from its thick portion 26 to passageway portion 50. Load applying member 42 includes a conical end portion 52, the purpose of which will hereinafter be discussed.

The stem portion 18 of body 16 is tightly screwed into an internally threaded opening formed in a wall of a chamber 54 containing a pressure fluid. This communicates the pressure fluid with the passageway 38, cavity 40, and the side of diaphragm 24 opposite the load applying member 42. As should be evident, a progressive increase in pressure within cavity 40 and against the diaphragm 24 will extend the load applying member 42 progressively outwardly through orifice 44. Member 42 will continue to move outwardly in response to an increasing pressure signal until its base portion 48 makes contact with shoulder 56 formed by juncture of passageway portions 44 and 50. Similarly, commencing with a relatively large pressure in cavity 40, a progressive decrease in such pressure signal will result in a corresponding progressive retraction of member 42.

The electrical parts portion 12 of the switch mechanism includes a main body 58 which is preferably constructed from an insulative material. It is shown in FIG. 1 to include inner end portions 60, 62, 63 which, when the parts are assembled, make contact with corresponding surface portions of the inner end of sensor portion 10 (i.e. the exposed face of insert 22). Body 58 is recessed at its inner end between the end portions 60, 62, 63.

As best shown by FIG. 2, body 58 includes an inwardly opening socket 72 communicating at its outer end with a smaller dimension opening 78. An adjustment screw 80, having an allen wrench receiving socket 82 at its outer end, is threaded into the opening 78. The inner end of adjustment screw 80 bears against a disk 76 which in turn contacts the outer end of a coil type compression spring 84. The inner end of spring 84 rests against a shoulder portion 86 of a biasing member 88. Biasing member 88 includes an elongated stem portion 90 which extends downwardly through the open center of the coil spring 84. Preferably, it also includes a conical point portion 92 which is directed in the opposite direction from the conical point portion 52 of load applying member 42. In the preferred embodiment, both load applying member 42 and biasing member 88 are mounted for reciprocating rectilinear travel. Their movement is along axes which are parallel to each other. The axis of travel of load applying member 42 coincides with the center line axis of the switch mechanism, whereas the line of travel of biasing member 88 is radially offset from such center line.

Body 58 is formed to include two side recesses, the first of which is defined generally by a radial surface 94, side surfaces 64, 65, and a chord surface 96, and the second of which is defined generally by a radial surface 95, side surfaces 66, 67, and a chord surface 97. A self-contained switch is located within each recess. A first switch 98 is mounted in the first recess and is attached to chord surface 96 by a screw 100. A second switch 99 is mounted in the second recess and is attached to chord surface 97 by a screw 101. Each switch 98, 99 may be a Micro (trademark) brand snap-action switch or the like.

Figure 6:
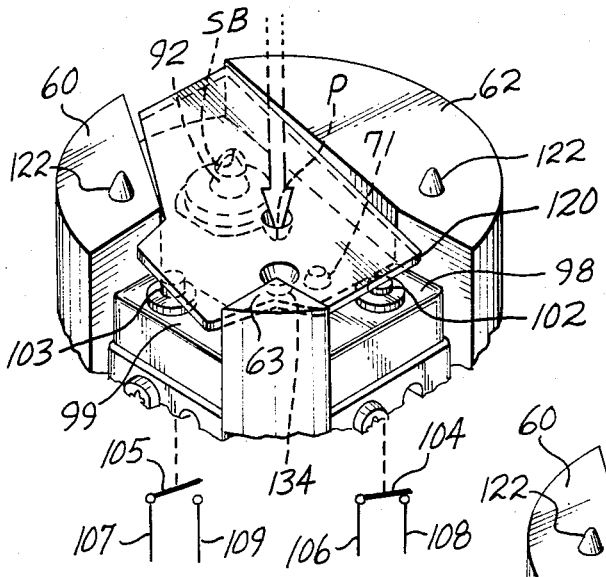
FIGS. 6 through 8 are pictorial views looking down on the preferred embodiment of the first body portion of the switch mechanism and the movable plate, illustrating the first, second, and third operational modes of the switch mechanism, respectively.
Figure 7:
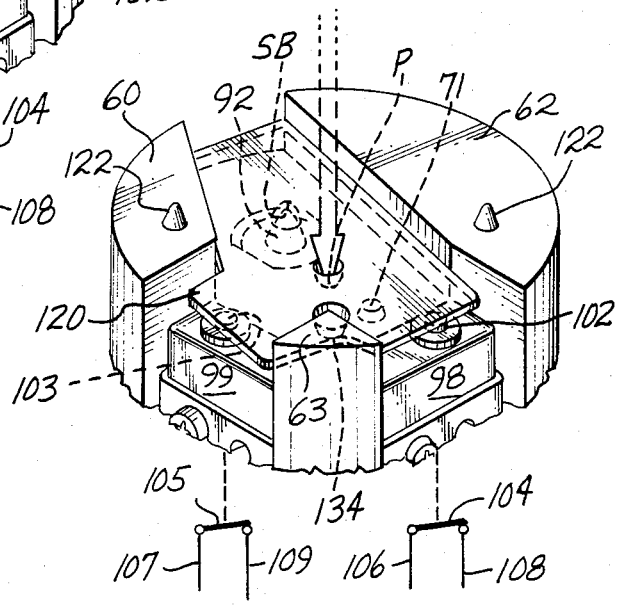
Figure 8:
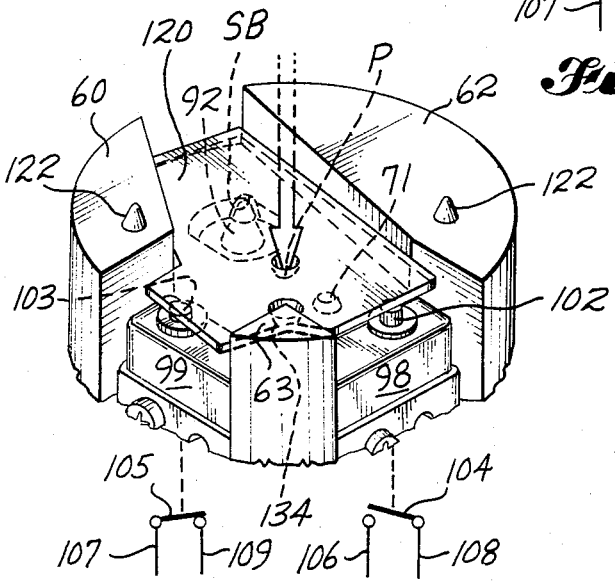

In FIGS. 6–8, each switch 98, 99 is schematically shown to include a reciprocating button or operator 102, 103 which is connected to a movable conductor 104, 105. Conductors 104, 105 are each adapted to bridge between a pair of conductors 106, 108 and 107, 109, respectively, when the corresponding operator 102, 103 is depressed. The first switch 98 includes a pair of conductors having headed ends 110, 112 which, when the switch 98 is secured to body 58, make conductive contact with the inner ends of a pair of parallel conductive bars that project axially through body 58 and endwise outwardly therefrom as terminals 114, 116. Similarly, the second switch 99 includes a pair of conductors having headed ends 111, 113 which make conductive contact with the inner ends of a pair of parallel conductive bars that project outwardly as terminals 115, 117, which are laterally spaced from terminals 114, 116. Conductive members 110, 114 and 112, 116 together form the conductors which are schematically shown at the right of FIGS. 6–8 and designated 106, 108 therein. Conductive members 111, 115 and 113, 117 together form the conductors which are schematically shown at the left of FIGS. 6–8 and designated 107, 109 therein.

The operators 102, 103 project axially of the electrical parts portion 12 from adjacent the level of the base of the inner end recess formed in body 58. In other words, each operator 102, 103 projects outwardly from the inner boundary 118, 119 of its switch 98, 99, and such inner boundaries 118, 119 are substantially even with the base surface of the recess.

Body 58 also includes a passageway 68 extending axially therethrough parallel to socket 72 and opening 78. An adjustment screw 70 is threaded into the upper portion of passageway 68 and has an allen wrench receiving socket 74 at its outer end. (See FIG. 2) The inner end 71 of screw 70 is rounded and projects axially of portion 12 from the base surface of the inner end recess formed in body 58. The amount by which the rounded end 71 of screw 70 projects from the base of the recess can be adjusted by turning screw 70 within passageway 68, as will be more fully described below.

A movable member 120, which in the illustrated embodiment is in the form of a substantially flat plate, is supported on the biasing member 88. The biasing spring 84, acting on movable member 120 via the biasing member 88, holds the movable member 120 in the rest position shown in FIG. 2. As will hereinafter be explained in some detail, when the sensor and electrical parts portions 10, 12 are together, the point portion 52 of the load applying member 42 makes contact with one side 136 of the movable member 120 at a location laterally offset from the contact made by the biasing member 88 on the other side 138 of member 120. Also, an edge portion of said other side 138 of movable member 120

(designated A in FIG. 5) makes contact with an inner end surface portion of the insert 22.

The body 58 is preferably formed to include axially inwardly extending locating pins 122, formed on end portions 60, 62 for engaging a pair of sockets 124 on the inner end surface of insert 22. When the locator pins 122 are positioned within the sockets 124, the sensor portion 10 is exactly axially aligned with the electrical parts portion 12, and the load applying member 42 makes proper contact with the movable member 120. In the preferred embodiment shown in the drawings, there are four sockets 124, so that the maximum rotation required to properly position sensor portion 10 is 45 degrees. FIG. 2 shows the two portions 10, 12 joined and the outer casing 14 in place for holding them together, making the switch mechanism a single unit having the electrical terminals 114, 116 and 115, 117 at one of its ends and the threaded connector 18 for a pressure signal conduit at its opposite end. As shown by FIG. 1, one end of casing 14 may have a prerolled edge 126, adapted to engage a chamfered surface 128 provided at the periphery of the terminal end of body 58. Following assembly of the two portions 10, 12, together and within casing 14, the opposite end of the casing 14 may be provided with a rolled edge 130 which is moved into tight engagement with a second chamfer 132 formed on body 16.

The movable member 120 has an essentially conical projection 134 on its substantially flat side 138 facing toward the electrical parts portion 12. Projection 134 is positioned to contact the base surface of the inner recess formed in body 58 during certain operational modes of the switch mechanism. The location of contact of such projection 134 with such base surface is designated C in FIG. 5.

The relative spacing of the reciprocating operators 102, 103 of switches 98, 99, the edge portion A of movable member 120 that contacts insert 22, the points of contact between the movable member 120 and the load applying member 42 and the biasing member 88, the rounded end 71 of screw 70, and conical projection 134 is such that predetermined degrees of movement of the load applying member 42 toward the movable member 120 produce predetermined movements of movable member 120. Each of these movements results in a desired mode of operation of the switch mechanism. The spacing in the preferred embodiment shown in the drawings is as follows: Spaced radially inwardly from edge portion A, between edge A and the point of contact P between movable member 120 and load applying member 42, is the point of contact SB between biasing member 88 and movable member 120. Point of contact P coincides with the center line axis of the switch mechanism. Location B at which the reciprocating operator 102 of the first snap-action switch 98 contacts the movable member 120 is located at a corner portion of member 120 substantially diametrically opposite edge A. Location E (where the rounded end 71 of screw 70 contacts movable member 120) is radially between and slightly laterally offset from locations B and P. The location of contact C (conical projection 134) is similarly positioned radially between locations B and P but is further offset laterally. Location D at which the reciprocating operator 103 of the second switch 99 contacts the movable member 120 is located at another corner portion of member 120 that is approximately midway between edge A and location B and is laterally offset from edge A, location B, and point P.

The operation of the switch mechanism will now be described (See FIG. 5):

Let it be assumed that the inlet 18 of the switch mechanism is connected to a conduit having an opposite end which is connected to a chamber containing a fluid under pressure which is subject to changes in pressure. Let it also be assumed that the switch mechanism is initially at the static or unloaded condition shown by FIG. 2, in which edge A contacts the inner end surface of insert 22, conical tips 52, 92 of members 42, 88 contact movable member 120, member 120 is spaced from reciprocating operators 102, 103 and screw 70, and conical projection 134 is spaced from body 58. Let it now be assumed that the pressure acting on the diaphragm 24 starts to steadily increase. At a first predetermined pressure level, which may be considered to be a low pressure level, the fluid pressure acting on the diaphragm 24 will displace the load applying member 42 axially outwardly a first predetermined amount. As member 42 moves, it exerts a force on the movable member 120, acting at the end of a relatively long moment arm x, causing the movable member 120 to pivot or tilt about a line or first axis $a_1$ until movable member 120 makes contact with the reciprocating operator 102 of first switch 98. Axis $a_1$ is defined by the line along which the inner end surface portion of insert 22 makes supporting contact with edge A of movable member 120. When movable member 120 makes contact with reciprocating operator 102 at location B, member 120 depresses operator 102 to operate first switch 98. The switch 98 may be a part of a first electrical circuit which is arranged to cause a particular thing to happen in response to a rise in pressure to said predetermined low level.

As the pressure continues to increase, the movable member 120 continues to pivot about axis $a_1$, and further depresses the reciprocating operator 102 until operator 102 "bottoms out". Member 120 then pivots slightly about axis $a_5$, defined by locations B and H, until conical projection 134 on member 120 contacts the base surface of the inner recess formed in body 58 at location C. Location H is at one end of line A.

When the pressure within chamber 40 increases further to a second or intermediate level, the load applying member 42 is projected outwardly toward the movable member 120 a second predetermined amount. The intermediate level force applied by the load applying member 42 against the movable member 120 acts about a shorter amount arm y and causes the movable member 120 to pivot about a second axis $a_2$. This second axis $a_2$ is defined by locations B and C, associated respectively with the reciprocating operator 102 of the first switch 98 and the conical projection 134 on the movable member 120. Movable member 120 pivots in response to the intermediate force until it contacts and depresses the reciprocating operator 103 of the second snap-action switch 99, at location D. Second switch 99 is a part of a second electrical circuit that is arranged to cause a predetermined thing to happen in response to a rise in pressure within pressure chamber 40 to an intermediate level. Preferably, the pivoting of the movable member 120 in response to the intermediate level force is in two stages. First, the movable member 120 pivots about axis $a_2$ until it makes contact with location E, i.e. until it contacts the rounded tip 71 of adjustment screw 70. When this contact is made, the pivoting motion of the movable member 120 about axis $a_2$ transfers to movement about an auxiliary axis $a_4$ defined by locations C and E. Movable member 120 pivots about auxiliary axis $a_4$ until it contacts and depresses reciprocating operator 103.

When the pressure acting on diaphragm 24 increases still further, substantially increasing the force applied by member 42 against movable member 120, the high or upper level force applied by member 42 acts at the end of a relatively short moment arm z. This causes the movable member 120 to pivot in position about a third axis $a_3$ until contact with the reciprocating operator 102 of the first switch 98 at location B is broken. Axis $a_3$ is defined by locations D and E, at which the movable member 120 contacts the reciprocating operator 103 of the second switch 99 and the rounded tip 71 of adjustment screw 70, respectively. Thus, when the movable member 120 has pivoted in response to the upper level force, reciprocating operator 103 remains depressed but reciprocating operator 102 is no longer depressed. As in the case of the response to the intermediate level force, it is preferable that the pivoting movement of the movable member 120 resulting from the upper level force occur in two stages. First, the movable member 120 pivots about auxiliary axis $a_4$, described above, further depressing the reciprocating operator 103 at location D until operator 103 "bottoms out". Then, the pivotal axis transfers to axis $a_3$, about which the movable member 120 pivots away from contact with reciprocating operator 102 of first switch 98.

In each of the above-described situations, the force applied by the load applying member 42 against the movable member 120 acts about an increasingly shorter moment arm (disregarding the moment arm x' associated with axis $a_5$). The sequence of moment arms is the relatively long moment arm x, the somewhat shorter moment arm y, the still shorter moment arm z' (about which the force acts when the movable member is pivoting about auxiliary axis $a_4$), and moment arm z which is the shortest of the four moment arms. It should be obvious that, starting with a situation in which the force of the load applying member 42 is at a high level, a progressive decrease in such force will result in pivotal movements of the movable member 120 and a sequence of moment arms that are the reverse of those described above.

Also in each of the above-described situations, the force applied against movable member 120 by the force applying member 42 is countered by the force of the spring 84, exerted via the biasing member 88. In the case of rotation about the first axis $a_1$, the force of spring 84 is applied at the end of a moment arm r. In the case of rotation about axis $a_5$, the force of spring 84 is applied at the end of moment arm r'. In the case of rotation about axis $a_2$, the force of spring 84 is applied at the end of a moment arm s. In the case of rotation about the auxiliary axis $a_4$, the force of spring 84 is applied at the end of a moment arm t'. In the case of rotation about the third axis $a_3$, the force of spring 84 is applied at the end of a moment arm t.

As noted above, the magnitude of movement of the load applying member 42 toward the movable member 120 required to produce each of the desired movements of the movable member 120 is initially determined by the relative spacing of the several contact locations A (and H), B, C, D, E, P, and SB. This relative spacing establishes the lengths of the several moment arms and, therefore, the magnitude of force required to move the movable member 120 into each of the three positions corresponding with the three operating modes of the switch mechanism. Of course, the force of biasing spring 84 also effects the magnitude of force required. The adjustment screw 80 provides a means of adjusting the force of biasing spring 84. Similarly, adjustment screw 70 may be adjusted toward or away from movable member 120 in order to precisely locate contact location E.

It should be evident that the relative distance of contact locations P and SB from each of the five axes determines the relative pressures at which each rotation occurs, depending on the leverage P has over SB in each case. It should be further apparent that leverage about each axis may be changed without affecting the leverage about the other axes (unless a location is moved that is common to two axes). Thus, the relative pressures required to produce each mode of the switch mechanism may easily be adjusted by the design of the movable member 120 and its locations of contact. It should also be apparent that adjustment of the force of spring 84 and the area over which the pressure acts (in chamber 40) will adjust the actual pressures at which each mode occurs, thus providing freedom of design of the actual as well as the relative pressure levels at which the switch mechanism functions.

As stated above, one of the objects of the present invention is to provide a multimodal pressure switch that has an increased differential range to reduce cycling frequency. There are several features of the present invention that contribute toward realization of this object. One such feature is the inclusion of one or more snap-action switches. Such switches are fast acting and have clear-cut on and off positions. Thus, as the movable member 120 moves to change the switch mechanism from one mode to the another, a snap-action switch affected by the movement cleanly and very quickly snaps on or off. In addition, as the pressure varies between two levels which correspond to two different modes, each switch is definitely on or off and its condition does not change until the movable member 120 has moved into a position corresponding with another mode of the switch mechanism. The switch mechanism can be adjusted as described above to determine the pressure ranges between the different modes of operation.

Another feature of the present invention that affects the differential ranges of the switch mechanism is the inclusion of adjustment screw 70 and conical projection 134, each of which acts as a fulcrum means. During operation of the switch mechanism, these fulcrums define the auxiliary axis $a_4$. The presence of auxiliary axis $a_4$ has the desirable result of causing the pivotal movement of the movable member 120 in response to a rise in pressure to an intermediate level, as well as the pivotal movement of the movable member 120 in response to a rise in pressure to an upper level, to be in two stages. Each such two-stage pivotal movement increases a differential range of the switch mechanism by slowing the response of the switch mechanism to a change in pressure and therefore delaying the activation or deactivation of the snap-action switch involved. Each increase in differential range, of course, also applies to the response of the movable member 120 to a drop in pressure from either the upper level or the intermediate level. The fulcrums 71 and 134 also have another function. They share the load with the reciprocating operators 102, 103. This helps prevent mushrooming of the operators 102, 103 and damage to the switches 98, 99.

FIG. 10 illustrates the operation of a switch mechanism constructed according to the invention in a typical installation, such as in the air-conditioning system of a vehicle. The movable member 120 is initially in the rest position shown in FIG. 2 with the system being in an "uncharged" or zero pressure state. As the system is charged with refrigerant, the pressure rises. Movable member 120 pivots about axis $a_1$ in response to the increasing pressure to depress the reciprocating operator 102 of the first switch 98. At a predetermined low level, say 40 pounds per square inch, the first switch 98 is actuated. The resulting first mode of operation is illustrated in FIG. 6. As the pressure in the system increases above its predetermined low level, the movable member 120 pivots to depress the reciprocating operator 103 of the second switch 99 while remaining in depressing contact with reciprocating operator 102. At a predetermined intermediate pressure level, shown in FIG. 10 to be 200 pounds per square inch, the second switch 99 is actuated (and first switch 98 remains actuated). This results in the second mode of operation of the switch mechanism illustrated in FIG. 7. In the system illustrated in FIG. 10, the activation of the second switch results in the activation of a device that reduces the pressure level. Such a device could be, for example, an auxiliary cooling device, such as a fan that draws air across the condenser of an air-conditioning system in a vehicle. As shown in FIG. 10, activation of the second switch 99 causes a pressure drop to approximately 150 pounds per square inch. As the pressure drops, the movable member 120 moves back toward the position illustrated in FIG. 6 corresponding to the first mode of operation of the mechanism. When the pressure has dropped to 150 pounds per square inch, the second switch 99 is deactivated and the pressure again rises to 200 pounds per square inch. In the system illustrated, the normal operation involves a regular cycling within the differential range of the second mode of operation—the mid differential range indicated in FIG. 10. As described above, the structure and operation of the switch mechanism of the present invention provides a sufficiently large mid differential range to slow the regular cycling to a frequency in which oscillations are avoided and undue wear of the system is prevented.

Should for some reason the pressure in the system continue to build up after the switch mechanism has moved into its second mode, the movable member 120 will pivot toward a position corresponding with a third mode of operation of the switch mechanism. When the pressure reaches approximately 300 pounds per square inch, first switch 98 is deactivated. The resulting third mode of operation is illustrated in FIG. 8 in which second switch 99 is shown activated and first switch 98 is shown deactivated. The deactivation of first switch 98 stops the source of pressure within the system, thereby allowing the pressure to drop back down to a safe level. (The auxiliary cooling device which causes the pressure to drop remains activated throughout the third mode of operation.) As the pressure drops down to about 200 pounds per square inch, the switch mechanism moves back into its second mode of operation and, unless there is a malfunction in the system, the normal cycling within the mid differential range recommences. The large differential range of the third mode is indicated in FIG. 10 and designated "high differential". The magnitude of this differential range, made possible by the structure and operation of the switch mechanism constructed according to the invention, provides smooth functioning of the switch mechanism and the air-conditioning system.

As described above, the switch mechanism does not enter its first mode (switch 98 on) until the pressure reaches about 40 pounds per square inch. The mechanism also moves out of its first mode and into the rest position shown in FIG. 2 should the pressure drop below this low level. This ensures that the system will shut off in the event of a loss of pressure in the system corresponding to a loss of refrigerant.

It is to be recognized that other embodiments of the invention may be made in which only some of the features of the illustrated embodiment are utilized. For example, an embodiment of the invention may totally eliminate the second snap-action switch 99, so that a first sensed signal will activate switch 98 and a second sensed signal will deactivate switch 98. Also, it is to be recognized that the modes of operation illustrated in FIG. 10 and described herein have been so illustrated and described for illustrative purposes. Of course, a different arrangement of electrical circuits and on and off conditions can be provided to suit the needs of a particular system in which the switch mechanism of the invention is to be incorporated. For example, by making well-known changes in the circuit design, the activated and deactivated conditions of either or both of the switches 98, 99 may be interchanged.

Another example of a possible modification consistent with the scope of the invention is the provision of snap-action switches at locations of contact other than B and D in addition to or instead of the switches in the illustrated embodiment.

It will be obvious to those skilled in the art to which this invention is addressed and that the invention may be used to advantage in a variety of situations. Therefore, it is also to be understood by those skilled in the art that various changes, modifications, and omissions in form and detail may be made without departing from the spirit and scope of the present invention as defined by the following claims.

What is claimed is:

1. A switch mechanism comprising:

a snap-action switch which in use forms a part of an electrical circuit, said switch having a reciprocating operator;

a movable member with a first side facing toward the reciprocating operator, and a second side essentially opposite said first side;

support means for supporting the movable member by making supporting contact with at least two support points on said second side;

a biasing member which makes point contact with said first side of the movable member at a location that is offset from both the reciprocating operator and said support points;

means for mounting the biasing member for reciprocating movement along a line that includes its point of contact with the movable member and that extends generally transversely of the movable member;

spring means for biasing the biasing member toward the movable member and the movable member into contact with the support means and into a spaced relationship with the reciprocating operator;

a load applying member which makes point contact with said second side of the movable member at a location spaced toward the reciprocating operator from both the biasing member and said support points;

means for supporting the load applying member for movement along a line that includes its point of contact with the movable member and that extends generally transversely of the movable member; and fulcrum means positioned to contact said first side of the movable member at a location spaced toward the reciprocating operator from the load applying member;

with the relative spacing of the reciprocating operator, said support points, the point of contact between the biasing member and the movable member, the point of contact between the load applying member and the movable member, and the fulcrum means being such that a first movement of the load applying member toward the movable member will pivot the movable member in position about a first axis that includes said support points, to depress the biasing member, compress the spring means, and move the movable member into contact with the reciprocating operator to depress said operator and operate the snap-action switch, and a subsequent additional movement of the load applying member in the same direction will cause the movable member to pivot in position about the fulcrum means, to further depress the biasing member, further compress the spring means, and move the movable member out of contact with the reciprocating operator.

2. A switch mechanism as described in claim 1, further comprising a second snap-action switch which in use forms a part of a second electrical circuit, said second switch including a reciprocating operator positioned to be contacted and depressed by the movable member to operate said second switch in response to an intermediate movement of the load applying member in the same direction as said first and subsequent movements.

3. A switch mechanism as described in claim 2, further comprising second fulcrum means positioned to contact said first side of the movable member at a location that, together with the location of contact between the movable member and the reciprocating operator of the first snap-action switch, defines a second axis, from which both the reciprocating operator of the second snap-action switch and the point of contact between the load applying member and the movable member are laterally offset, to which said operator of said second switch is closer than is said point of contact with the load applying member, and about which the movable member pivots in response to an intermediate movement of the load applying member.

4. A switch mechanism as described in claim 3, in which the points of contact between the movable member and the first fulcrum means and the second fulcrum means together define an auxiliary axis from which the reciprocating operators of the first and second switches and the point of contact between the load applying member and the movable member are laterally offset; and in which, in response to an intermediate movement of the load applying member, the movable member first pivots about said second axis to make contact with the first fulcrum means and then pivots about said auxiliary axis to make contact with and depress the reciprocating operator of said second switch to operate said second switch.

5. A switch mechanism as described in claim 2, in which the location of contact between the movable member and the reciprocating operator of said second switch, together with the location of contact between the movable member and the fulcrum means, defines an axis, from which both the reciprocating operator of the first switch and the point of contact between the movable member and the load applying member are laterally offset, and about which the movable member pivots in response to said subsequent additional movement of the load applying member.

6. A switch mechanism as described in claim 5, which further comprises second fulcrum means positioned to contact said first side of the movable member at a location that, together with the location of contact between the first fulcrum means and the movable member, defines an auxiliary axis from which the reciprocating operators of the first and second switches and the point of contact between the load applying member and the movable member are laterally offset; and in which, in response to said subsequent additional movement of the load applying member, the movable member first pivots about said auxiliary axis against the reciprocating operator of said second switch and then pivots about said axis defined by the locations of contact between the movable member and the reciprocating operator of said second switch and the first fulcrum means to move out of contact with both the reciprocating operator of the first switch and the second fulcrum means.

7. A switch mechanism as described in claim 3, in which the location of contact between the movable member and the reciprocating operator of said second switch, together with the location of contact between the movable member and the first fulcrum means, defines a third axis, from which both the reciprocating operator of the first switch and the point of contact between the movable member and the load applying member are laterally offset, and about which the movable member pivots in response to said subsequent additional movement of the load applying member.

8. A switch mechanism as described in claim 7, in which the points of contact between the movable member and the first and second fulcrum means together define an auxiliary axis from which the reciprocating operators of the first and second switches and the point of contact between the load applying member and the movable member are laterally offset; and in which, in response to said subsequent additional movement of the load applying member, the movable member first pivots about said auxiliary axis against the reciprocating operator of said second switch and then pivots about said third axis to move out of contact with both the reciprocating operator of the first switch and the second fulcrum means.

9. A switch mechanism as described in claim 4, in which the location of contact between the movable member and the reciprocating operator of said second switch, together with the location of contact between the movable member and the first fulcrum means, defines a third axis, from which both the reciprocating operator of the first switch and the point of contact between the movable member and the load applying member are laterally offset, and about which the movable member pivots in response to said subsequent additional movement of the load applying member.

10. A switch mechanism as described in claim 9, in which, in response to said subsequent additional movement of the load applying member, the movable member first pivots about said auxiliary axis against the reciprocating operator of said second switch and then pivots about said third axis to move out of contact with both the reciprocating operator of the first switch and the second fulcrum means.

11. A switch mechanism as described in claim 10, in which the point of contact between the movable member and the load applying member is closer to the third axis than it is to the other three axes, closer to the auxiliary axis than it is to the first and second axes, and closer to the second axis than it is to the first axis.

12. A switch mechanism as described in claim 1, in which the movable member is in the form of a substantially flat plate, and the point of contact between said plate and the load applying member is at a laterally central location on said second side.

13. A switch mechanism as described in claim 1, further comprising means for receiving a pressure signal and applying it against the load applying member to cause said movements of the load applying member.

14. A switch mechanism as described in claim 1, in which the position of the fulcrum means is adjustable toward and away from the movable member to adjust the magnitude of subsequent additional movement of the movable member required to move the movable member out of contact with the reciprocating operator.

15. A switch mechanism as described in claim 4, in which the position of the first fulcrum means is adjustable toward and away from the movable member to adjust the magnitude of intermediate movement of the movable member required to depress the reciprocating operator of said second switch.

16. A switch mechanism as described in claim 1, in which said first movement of the load applying member first pivots the movable member about the first axis to operate the snap-action switch and then pivots the movable member about an axis defined by one of said support points and the location of contact between the movable member and the reciprocating operator.

17. A switch mechanism as described in claim 3, in which said first movement of the load applying member first pivots the movable member about first axis to operate the first snap-action switch and then pivots the movable member about an axis defined by one of said support points and the location of contact between the movable member and the reciprocating operator of said first switch to move the movable member into contact with said second fulcrum means.

18. A switch mechanism comprising:

a first portion having inner and outer ends and carrying a snap-action switch, said switch having a reciprocating operator positioned at said inner end and including a pair of conductive legs that project outwardly as terminals from said outer end;

a movable member with a first side facing toward said inner end and the reciprocating operator, and a second side essentially opposite said first side;

a biasing member which makes point contact with said first side of the movable member at a location that is offset from the reciprocating operator, and which is supported by said first portion for reciprocating movement along a line that includes its point of contact with the movable member and that extends generally transversely of the movable member;

a second portion having inner and outer ends, and including at its inner end support means for supporting the movable member by making supporting contact with at least two support points on said second side that are offset from both the reciprocating operator and the point of contact between the movable member and the biasing member;

spring means for biasing the biasing member toward the movable member and the movable member into contact with the support means and into a spaced relationship with the reciprocating operator;

a load applying member which makes point contact with said second side of the movable member at a location spaced toward the reciprocating operator from both the biasing member and said support points, and which is supported by said second portion for reciprocating movement along a line that includes its point of contact with the movable member and that extends generally transversely of the movable member; and fulcrum means positioned on said inner end of said first portion to contact said first side of the movable member at a location spaced toward the reciprocating operator from the load applying member;

with the relative spacing of the reciprocating operator, said support points, the point of contact between the biasing member and the movable member, the point of contact between the load applying member and the movable member, and the fulcrum means being such that a first movement of the load applying member toward the movable member will pivot the movable member in position about a first axis that includes said support points, to depress the biasing member, compress the spring means, and move the movable member into contact with the reciprocating operator to depress said operator and operate the snap-action switch, and a subsequent additional movement of the load applying member in the same direction will cause the movable member to pivot in position about the fulcrum means, to further depress the biasing member, further compress the spring means, and move the movable member out of contact with the reciprocating operator.

19. A switch mechanism as described in claim 18, in which said second portion includes means for receiving a pressure signal and applying it against the load applying member to cause said movements of the load applying member.

20. A switch mechanism as described in claim 18, further comprising a second snap-action switch carried by said first portion, said second switch having a reciprocating operator positioned at said inner end of said first portion to be contacted and depressed by the movable member to operate said second switch in response to an intermediate movement of the load applying member in the same direction as said first and subsequent movements, and said second switch including a pair of conductive legs that project outwardly as terminals from said outer end of said first portion and that are laterally spaced from the conductive legs of the first switch.

* * * * *

UNITED STATES PATENT AND TRADEMARK OFFICE

CERTIFICATE OF CORRECTION

PATENT NO. : 4,493,957

DATED : January 15, 1985

INVENTOR(S) : Wayde H. Watters

It is certified that error appears in the above-identified patent and that said Letters Patent are hereby corrected as shown below:

Column 2, line 31, "when" should be --which--.

Column 10, line 49, "amount" should be --moment--.

Signed and Sealed this

*Twenty-third* Day of *July 1985*

[SEAL]

*Attest:*

DONALD J. QUIGG

*Attesting Officer* *Acting Commissioner of Patents and Trademarks*